US010600392B2

(12) United States Patent
Holcomb

(10) Patent No.: US 10,600,392 B2
(45) Date of Patent: Mar. 24, 2020

(54) ERGONOMIC PLECTRUM

(71) Applicant: Paul Holcomb, Palm City, FL (US)

(72) Inventor: Paul Holcomb, Palm City, FL (US)

( * ) Notice: Subject to any disclaimer, the term of this patent is extended or adjusted under 35 U.S.C. 154(b) by 0 days.

(21) Appl. No.: 16/266,753

(22) Filed: Feb. 4, 2019

(65) Prior Publication Data

US 2019/0304414 A1 Oct. 3, 2019

Related U.S. Application Data

(60) Provisional application No. 62/626,654, filed on Feb. 5, 2018.

(51) Int. Cl.
*G10D 3/16* (2020.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 6,346,662 B1 * 2/2002 Sielaff ..... G10D 3/163 84/320
2017/0011720 A1 * 1/2017 Pascale ..... G10D 3/163

* cited by examiner

*Primary Examiner* — Kimberly R Lockett

(57) ABSTRACT

A plectrum for strumming a stringed instrument comprises a body having a front side, a rear side, a center portion, and a periphery. The body has one or more pick tips having an edge adapted to strum a stringed instrument. An ergonomic contour is provided on the front side and/or the rear side of the body, the ergonomic contour having a protrusion that extends radially from the center portion toward the periphery, the protrusion having one or more projections or recesses. The ergonomic contour creates a surface that is contactable by the thumb or other finger of a user to aid in the gripping of the plectrum and reducing stress. The pick tips on the body may each be different. A method of using the plectrum includes rotating the plectrum between the fingers from one pick tip to another.

20 Claims, 5 Drawing Sheets

ERGONOMIC PLECTRUM

PRIORITY

The present application claims the benefit of domestic priority based on U.S. Provisional Patent Application 62/626,654 filed on Feb. 5, 2018, the entirety of which is incorporated herein by reference.

BACKGROUND

Almost everyone wants to play the guitar. Whether it is being able to sit around a campfire and play folk songs, serenade a loved one, or be the star on the stage in a rock band, everyone dreams of being a guitar idol. However, few realize the rigors and physical demands of prolonged playing of a guitar and other stringed instruments.

Guitarists are some of the most vulnerable musicians to hand injuries. Repetitive strain injuries or injuries of the musculoskeletal and/or nervous systems caused by repetitive tasks, forceful exertions, vibrations, mechanical compression, or sustained or awkward positions are particularly prevalent for guitar players. Examples of common problems include nerve compression syndromes, such as carpel tunnel syndrome and cubital tunnel syndrome. Tendonitis or inflammation of the tendons is also common in the wrist of a guitar player. Other ailments include tennis elbow, focal dystonia, and arthritis.

Surprisingly it is often the strumming hand rather than or in addition to the fret hand that develops the repetitive strain injuries. A plectrum, also known as a pick, is a traditionally flat tool used to pluck or strum a stringed instrument. Playing a guitar with a plectrum produces a bright sound compared to plucking with the fingertip. Plectrums also offer a greater contrast in tone across different plucking locations. For these reasons and more, most guitar players prefer to use a plectrum when playing. Thus, the strumming hand of a guitar player is often holding a plectrum by squeezing it between the thumb and one or more other fingers while the hand is making a strumming motion. These muscular stresses and awkward movements together over time can lead to fatigue and/or injury of the hand, such as one or more of the injuries discussed above.

Plectrum design has been largely unchanged since its first introduction as a flat surface in the late nineteenth century. Though different materials have been used and different thicknesses of the plectrum have been manufactured, very little has been done in terms of designing a plectrum that is more comfortable for the guitar player to hold and that reduces the likelihood of hand fatigue and injury. In addition, because of the uniform size and shape of a plectrum, only a single sound can be produced using conventional plectrums. Furthermore, because of their generally flat shape, plectrums are difficult to store and are easy for the guitarist to misplace.

There is therefore a need for a plectrum that is ergonomically designed and that has improved handleability. There is a further need for a plectrum that reduces hand fatigue and reduces the likelihood of hand injury. There is a further need for a plectrum that can produce multiple sounds. There is still a further need for a plectrum that is easy to store in connection with a stringed instrument.

SUMMARY

The present invention satisfies these needs. In one aspect of the invention, an improved plectrum is provided.

In another aspect of the invention, a plectrum has an ergonomic design that provides improved handling and/or that reduces hand fatigue and/or reduces the likelihood of hand injury.

In another aspect of the invention, a plectrum has the ability to produce different sounds or tones.

In another aspect of the invention, a plectrum has multiple different pick tips.

In another aspect of the invention, a plectrum has an ergonomic design including a raised portion that orients the plectrum in the hand of a user with respect to multiple pick tips.

In another aspect of the invention, a plectrum is attachable to the strings of a stringed instrument.

In another aspect of the invention, a plectrum for strumming a stringed instrument comprises a body having a front side, a rear side, a center portion, and a periphery, wherein the body has one or more pick tips having an edge adapted to strum a stringed instrument, and an ergonomic contour on the front side or the rear side of the body, the ergonomic contour comprising a protrusion that extends radially from the center portion toward the periphery, the protrusion having one or more projections or recesses, wherein the ergonomic contour creates a surface that is contactable by the thumb or other finger of a user to aid in the gripping of the plectrum.

In another aspect of the invention, a plectrum for strumming a stringed instrument comprises a body having a front side, a rear side, a center portion, and a periphery, wherein the body has a first pick tip having a first edge adapted to strum a stringed instrument and a second pick tip having a second edge adapted to strum a stringed instrument, and an ergonomic contour on the front side or the rear side of the body, the ergonomic contour comprising a first protrusion corresponding to the first pick tip and a second protrusion corresponding to the second pick tip, wherein the ergonomic contour creates a surface that is contactable by the thumb or other finger of a user to aid in the gripping of the plectrum.

In another aspect of the invention, a method of strumming a stringed instrument with a plectrum comprises providing a plectrum having a body having a front side, a rear side, a center portion, and a periphery, wherein the body has a first pick tip having a first edge adapted to strum a stringed instrument and a second pick tip having a second edge adapted to strum a stringed instrument, and an ergonomic contour on the front side or the rear side of the body, the ergonomic contour comprising a first protrusion corresponding to the first pick tip and a second protrusion corresponding to the second pick tip. The method further comprises contacting the front side with a thumb or other finger, contacting the rear side with a thumb or other finger, and rotating the plectrum between the fingers from a first position where the first pick tip is positioned to strum the stringed instrument to a second position where the second pick tip is positioned to strum the stringed instrument, wherein a different sound is produced in the first and second positions.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a plectrum for strumming strings of a stringed instrument. Although the plectrum is illustrated and described in some instances in the context of being useful as a guitar pick, the present invention can be useful in other instances. Accordingly, the present invention is not intended to be limited to the examples and embodiments described herein.

Figure 1A:
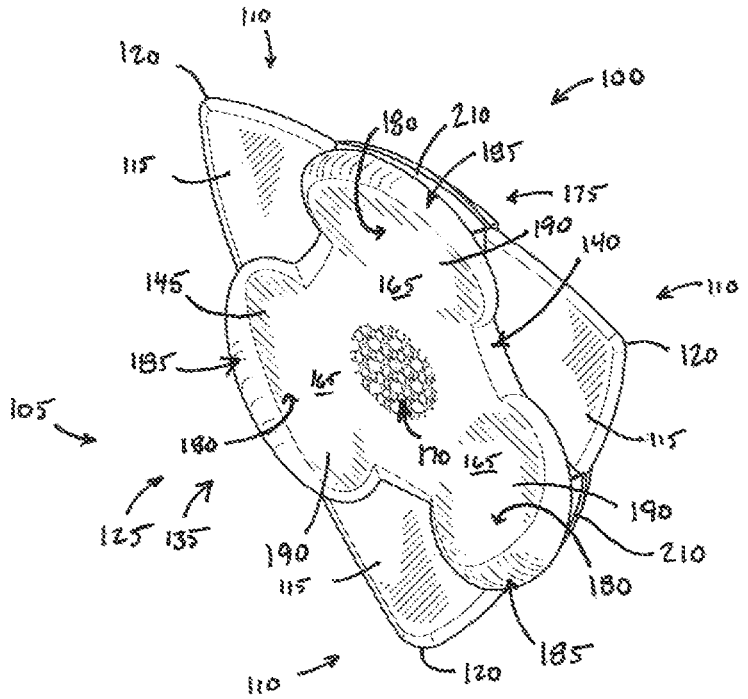
FIG. 1A is a schematic perspective front view of a plectrum according to the invention.
Figure 1B:
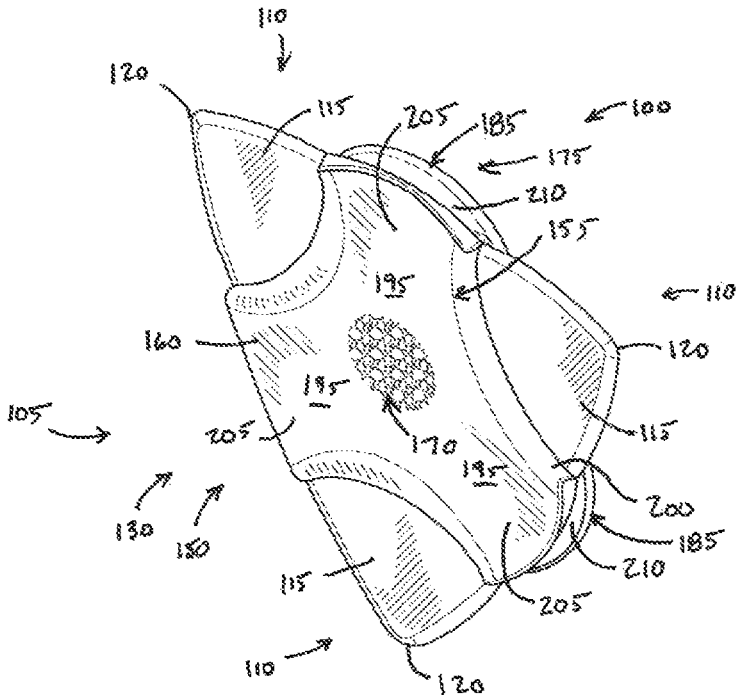
FIG. 1B is a schematic perspective rear view of the plectrum of FIG. 1A.

A plectrum 100 according to one version of the invention is shown in FIG. 1A and 1B. The plectrum 100, also known as a pick, is grasped by a user and is used to strum a stringed instrument, such as a guitar, mandolin, banjo, bass guitar, and the like. In the version of FIG. 1A, the plectrum 100 has a body 105 having a generally triangular profile that includes three angled corner portions 110. At least one of the angled corner portions 110 forms a pick tip 115 having an edge 120 that can be used to contact the strings of a stringed instrument and to strum or pluck one or more of the stings to make music. The plectrum 100 has a front face 125 and a rear face 130. A user grasps the plectrum 100 by contacting the front face 125 with the user's thumb and the rear face 130 with a user's finger, such as an index finger and/or middle finger. The plectrum 100 is thus squeezed between the user's thumb and finger in such a way that a pick tip 115 and its associated edge 120 is positioned so that it may contact the strings of the stringed instrument. The plectrum 100 may be made from any suitable material, such as one or more of plastic, such as nylon, Delrin, celluloid, rubber, felt, tortoiseshell, wood, metal, glass, tagua, stone, and the like.

The plectrum 100 may be gripped and manipulated in any of numerous manners. For example, the plectrum 100 may be gripped with two fingers, such as the thumb and the index finger or the thumb and the middle finger. Alternatively, the plectrum may be gripped with three fingers, such as the thumb, the index finger, and the middle finger. The motion of the plectrum 100 against the strings of the stringed instrument also can vary from user to user. For example, a user may hold the plectrum very stiffly between the thumb and index finger, locking the thumb joint and striking with the surface of the pick nearly parallel to the string. Alternatively, a user may use a technique where the thumb joint is bent on the downstroke and straightened on the upstroke, causing the tip of the pick to move in a circular pattern, which can allow speed and fluidity. Many rock guitarists use a flourish or pick slide that involves scraping the pick along the length of a round wound string. Whatever the grip and motion, the user of a plectrum must apply substantial gripping pressure in order to keep the plectrum from slipping. This pressure can place tremendous stress on the fingers, hands, and wrists of the user, especially when used over prolonged periods of time.

Accordingly, in order to help alleviate some of the stresses associated with playing the stringed instrument, in one version of the plectrum 100 of the invention a front ergonomic contour 135 is provided on the front face 125 of the plectrum 100. The front ergonomic contour 135 includes one or more front projections and/or recesses 140. The front projections and/or recesses 140 create a front surface 145 that is contactable by the thumb or other finger of the user to aid in the gripping of the plectrum 100. Additionally or alternatively, as shown in FIG. 1B, the plectrum 100 may include a rear ergonomic contour 150 on its rear face 130. The rear ergonomic contour 150 may include one or more rear projections and/or recesses 155 create a rear surface 160 that is contactable by the index or other finger of a user to aid in the gripping of the plectrum 100. The plectrum 100 may include a front ergonomic contour 135, a rear ergonomic contour 150, or both. When both are provided, the front ergonomic contour 135 and the rear ergonomic contour may have the same shape or may be differently shaped.

The front ergonomic contour 135 and/or the rear ergonomic contour 150 extend outwardly from the front face 125 and/or rear face 120, respectively, of the plectrum 100 to provide improved ergonomics for the user. The front surface 145 is shaped to receive a thumb of a user so that the user may more easily grasp the plectrum 100 with the thumb. The front projections and/or recesses 140 conform comfortably to the thumb and provide additional friction or a perch for the thumb, and thus the plectrum 100 with the front ergonomic contour 135 can be secured under the thumb with less thumb stress and pressure. When less pressure is needed, the soft tissue in the hand can be less strained and the wrist can move more freely. As a result, the user can experience less hand fatigue, discomfort, and fewer wrist ailments, such as carpel tunnel syndrome. In like manner, the rear ergonomic contour 150 with its rear projections and/or recesses 155 conform comfortably to a finger of the user and provide additional friction or perches for the finger. As a result of the front ergonomic contour 135 and/or the rear ergonomic contour 150, the plectrum 100 can be grasped with decreased pinching pressure which can not only reduce injury but can in some cases loosen the wrist and improve guitar playing ability.

In the version of FIG. 1A, the front ergonomic contour 135 of the plectrum 100 includes one or more front radially extending protrusions 165. The front radially extending protrusions are raised portions that protrude from the front face 125 and extend from the center portion 170 of the plectrum towards the periphery 175 of the plectrum 100. The front radially extending protrusion projects 165 away from a surface of the angled corner portions 110 so that it rises forwardly out of a plane generally formed by the angled corner portions 110. On the front radially extending protrusion 165 is a recessed portion 180 that forms a concave divot in the front radially extending protrusion 165. The front radially extending protrusion 165 and the recessed portion 180 form the front surface 145 that is adapted to contact the thumb or other finger of the user. The recessed portion 180 can be a concave surface, such as by being partially bowl shaped, partially cylindrically shaped, partially boxed shaped, or the like or a combination of any of these shapes. In the version of FIG. 1A, the front radially extending protrusion 165 includes one or more lobes 185 where each lobe 185 has a recessed portion 180 in the form of a bowl 190. In the version of FIG. 1A, the front ergonomic contour 135 provides a stabilization cradle for the user's thumb. The design accommodates a broad range of hand sizes by creating a bowl-shaped platform for the thumb to rest upon during strumming. The front ergonomic contour 135 may include three lobes 185, as shown. An increased width of the grip platform creates a more stable surface for the user to handle.

To further help alleviate some of the stresses associated with playing the stringed instrument, and as shown in FIG. 1B, in one version of the plectrum 100 of the invention a rear ergonomic contour 150 is provided on the rear face 130 of the plectrum 100. The rear ergonomic contour 150 includes one or more rear radially extending protrusions 195 extending from the center portion 170 towards the periphery 175 of the plectrum 100. The rear radially extending protrusion 195 projects away from a surface of the angled corner portions 110 so that it rises rearwardly out of a plane generally formed by the angled corner portions 110. In the version of FIG. 1B, the rear radially extending protrusion 195 includes a sidewall 200 and a substantially flat portion 205. In the version shown, the flat portions 205 lie substantially in a plane generally parallel to a plane containing the angled corner portions 110 and/or the edges 120. The sidewall 200 and the flat portion 205 make up the rear surface 160 that is adapted to contact the finger of the user to provide for improved contact between the finger and the plectrum 100. By providing a perch for the finger, grip pressure needed to hold the plectrum 100 can be reduced.

As can also be seen in FIG. 1A, the lobes 185 of the front radially extending protrusion 165 can include a body that is tilted so that the end of the lobe 185 near the periphery 175 of the plectrum 100 is a greater distance from the front face 125 than the portion of the lobe 185 near the center portion 170. In one version, the end of the lobe 185 near the periphery 175 extends from the front face 125 in a manner so that a slot 210 is provided between the end of the lobe 185 and a portion of the front face 125 lying in the plane containing the three angled corner portions 110. Alternatively, the entire lobe 185 may extend from the front face 125 without a slot.

In the particular version of FIG. 1A, the front ergonomic contour 135 is made up of three front radially extending protrusions 165, each of which are raised from the front face 125 and each of which extend outwardly from the center 170 of the plectrum 100. The front radially extending protrusions 165 in this version are substantially equally spaced around the front face 125 so that they are about 120 degrees from one another. Similarly, the rear ergonomic contour 160 in the particular version of FIG. 1B is made up of three rear radially extending protrusions 195 that extend outwardly from the center 170 of the plectrum 100. The rear radially extending protrusions 195 in this version are substantially equally spaced around the rear face 130 so that they are about 120 degrees from one another.

Figure 2A:
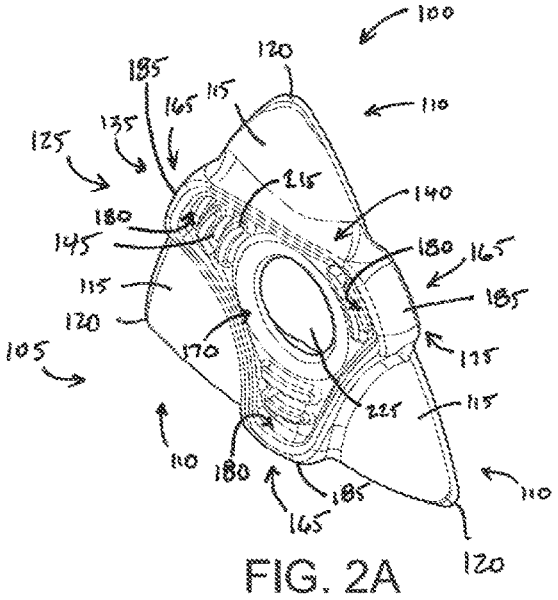
FIG. 2A is a schematic perspective front view of another version of a plectrum according to the invention.
Figure 2B:
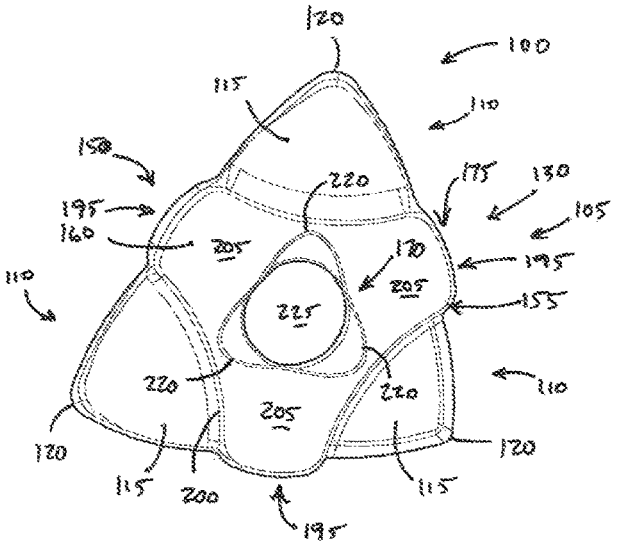
FIG. 2B is a schematic perspective rear view of the plectrum of FIG. 2A.
Figure 2C:
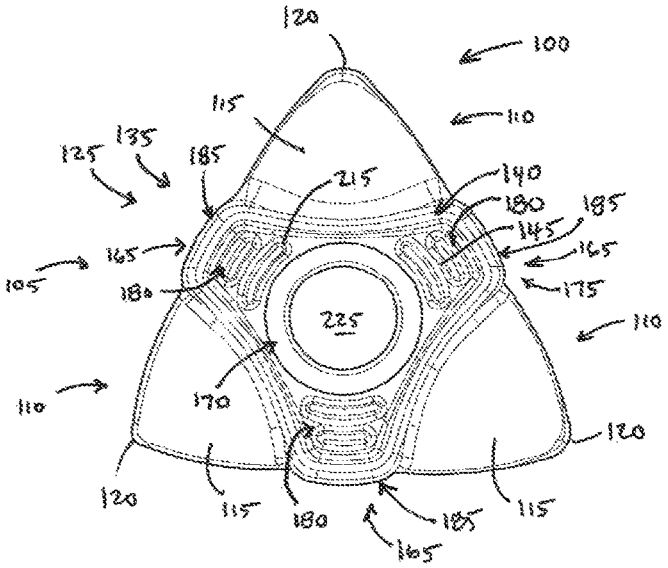
FIG. 2C is a schematic front view of the plectrum of FIG. 2A.
Figure 2D:
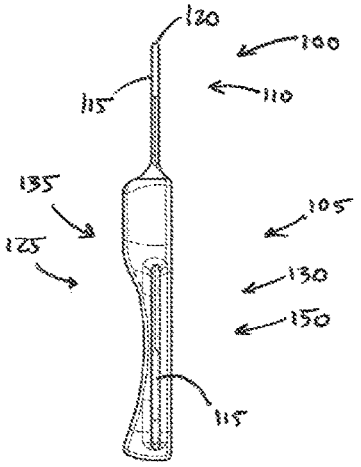
FIG. 2D is a schematic side view of the plectrum of FIG. 2A.
Figure 3A:
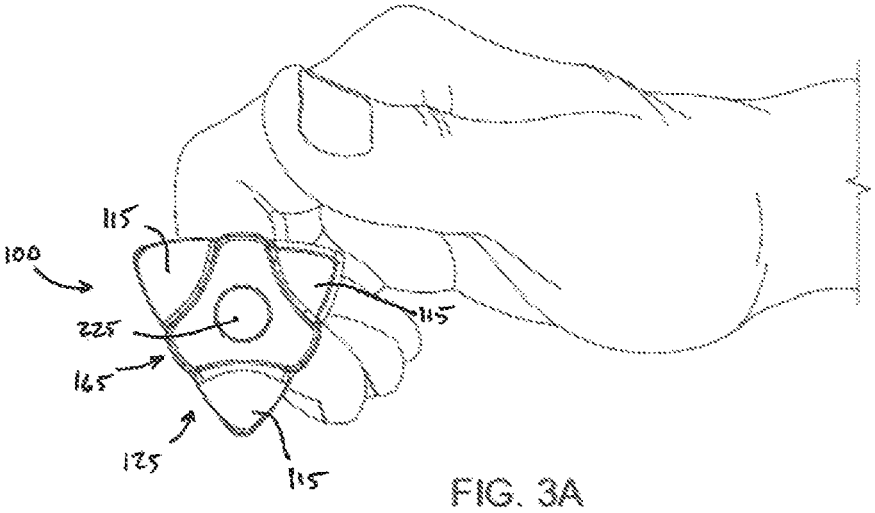
FIG. 3A is a schematic view of the plectrum of FIG. 2A being contacted by a finger.

Another version of a plectrum 100 is shown in FIGS. 2A through 2D. As can be seen in FIG. 2A, the front ergonomic contour 135 in this version has one or more, such as three, front radially extending protrusions 165 having a recess 180 with a U-shaped profile. Within the recess 180 are optionally provided one or more ridges 215 or other-shaped protrusions to provide additional contact surfaces for the thumb or other finger. Also provided in the version of FIGS. 2A through 2D are concave recesses 220 on or near the flat portions 205 of the rear radially extension protrusions 195. The concave recesses 220 can be provided along the direction of the rear radially extending protrusions 195, or as shown in FIG. 2B, can be provided between adjacent rear radially extending protrusions 195. In the version shown, a concave recess 220 is provided 180 degrees from a flat portion 205. This allows the tip of a finger to be received within the concave recess 220 when the finger is holding the plectrum 100 by contacting an opposite flat portion 205, as shown in FIG. 3A.

Figure 3B:
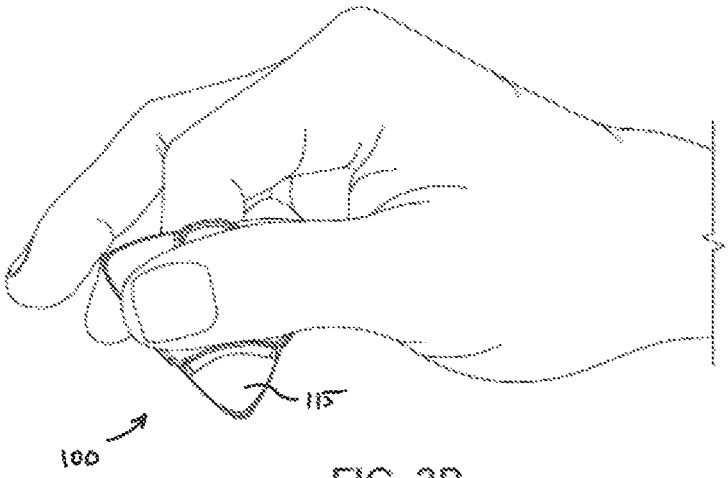
FIG. 3B is a schematic view of the plectrum of FIG. 2A being contacted by a finger and thumb.

Also as shown in the version of FIGS. 2A through 2D, the plectrum 100 can be provided with a opening 225 in its center portion 170. The opening allows the thumb and finger to contact one another when grasping the plectrum 100, as shown in FIG. 3B. The contact between the thumb and finger provides improve feel for the user. In addition, the opening 225 can include a wall with some thickness to further aid in the grasping of the plectrum 100. Also, the opening 225 and the contact between the thumb and finger allow the plectrum 100 to be easily rotated about an axis extending through the opening 225 which is important for reasons to be explained.

The plectrum 100 of the present invention may be provided with multiple pick tips 115 that are each the same or different. In one version, the plectrum 100 comprises a plurality of different pick tips 115 and in the version shown comprises three different pick tips 115. In this version, each pick tip 115 may have a different size, shape, and/or material that provides each pick tip 115 with a particular sound and/or handling characteristic. For example, in the version of FIGS. 1A and 1B, each pick tip 115 has a different thickness. By making the pick tips 115 a different thickness, the angles of the edges 120 are different. A thicker pick tip 115 produces an edge 120 with a heavier or wider angle than a thinner pick tip 115. Generally, the heavier edge 120 will produce what guitar players call a darker sound as opposed to the lighter sound produced by a thinner or sharper angled edge 120. By providing three pick tips 115 each of differing thicknesses, three different sounds are available to the guitarist. For example, each angled corner portion 110 can be one of: extra light/thin having a thickness of less than about 0.44 mm; light/thin having a thickness of from about 0.45 to about 0.69 mm; medium having a thickness of from about 0.70 to about 0.84 mm, heavy/thick having a thickness from about 0.85 to about 1.20 mm; or extra heavy/thick having an thickness greater than about 1.50 mm. In one version, the plectrum 100 has at least two angled corners with a different thickness. In another version, the plectrum 100 has all three angled corners with a different thickness from one another. The thicknesses, the name of the thicknesses, or other indicator can be marked on the angled corner portions 105.

Figure 4A:
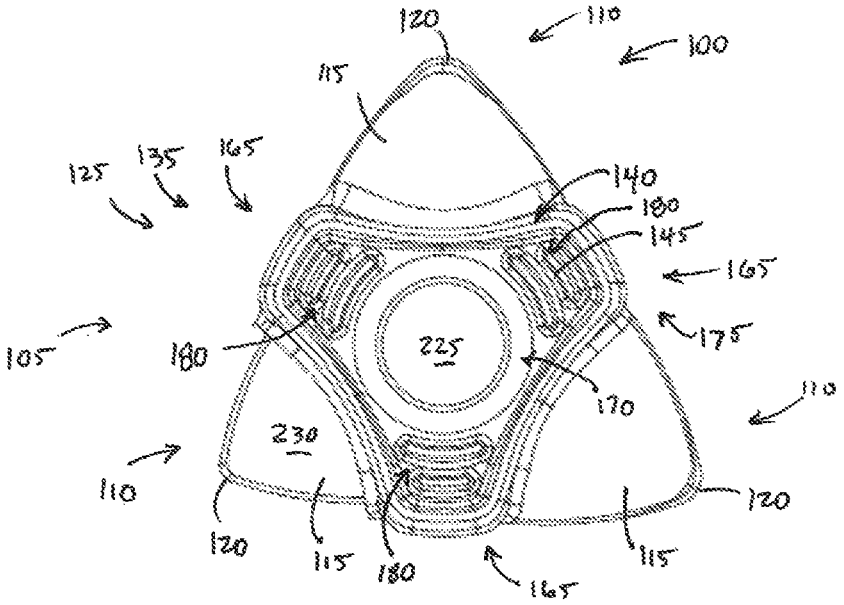
FIG. 4A is a schematic front view of another version of a plectrum according to the invention.
Figure 4B:
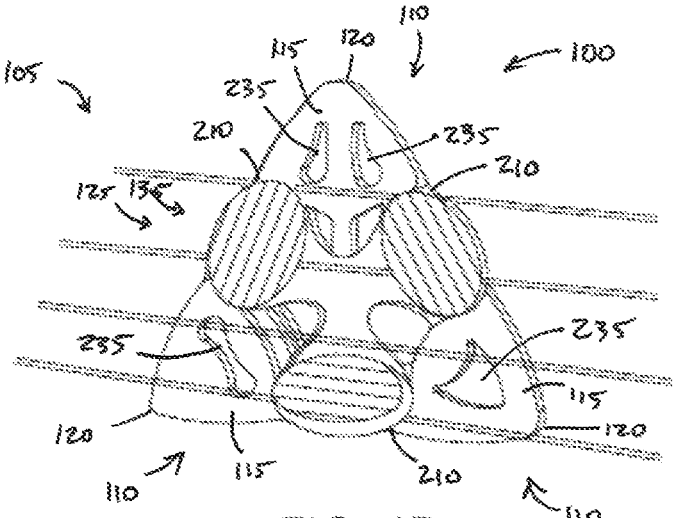
FIG. 4B is a schematic perspective view of another version of a plectrum according to the invention.

Additionally or alternatively, two or more of the angled corner portions 105 can have a different shape than the other or others. The shape of the tip 110 has a large influence on sound. A pointed tip produces a brighter, more focused sound, while a rounded tip produces a rounder, less defined sound. Accordingly, one of more of the pick tips 115 can have a more or less pointed edge 120 than the other or others. In another version, the overall size of pick tip can affect the sound generated. Therefore, in one version, one or more of the pick tips 115 can be a different size than the others. An example of this version is shown in FIG. 4A. In this version, the three pick tips 115 include a different sized pick tip 230. The different sized pick tip 230 can have a front face area that is 95% or less than the front face area of another pick tip 115. In another version, the different sized pick tip 230 can have a front face area that is 105% or more than the front face area of another pick tip 115. The different shape can also be provided in other ways, such as shown in FIG. 4B. In this version, different sizes and/or shaped apertures 235 are provided in the different pick tips 115. These aperture configurations can alter the sound produced by the different pick tips.

The front radially extending protrusions 165 and/or the rear radially extending protrusions 195 can be arranged so that they correspond to a pick tip 115. By correspond it is meant that at least one of the protrusions can be associated with one of the pick tips and another protrusion can be associated with a different pick tip. For example, one protrusion may be contacted by a thumb or other finger when a first pick tip is being used, and the second protrusion may be positioned so that it is contacted in substantially the same position when the second pick tip is being used. Alternatively, the protrusions may be positioned so they are contacted in a noticeably different manner to indicate to the user which pick tip is being used. In the version of FIGS. 1A and 1B and the version of FIGS. 2A through 2D, the radially extending protrusions 165, 195 are equally spaced around the plectrum 100 and are equally offset from a pick tip 115. In this manner, no matter which pick tip 115 is used, the front ergonomic contour 135 and/or the rear ergonomic contour 150 will feel substantially the same within the fingers of the user. Alternatively or additionally, the front ergonomic contour 135 and/or the rear ergonomic contour 150 can contain a textural indictor to indicate to the user which pick tip 115 is being used.

In use, a user grasps the plectrum 100 between two of the user's fingers, such as with the thumb contacting the front face 125 and the index finger contacting the rear face 130, as shown in FIG. 3B. The user can grasp the plectrum 100 in any manner that is comfortable to the user. When grasped in a first position, a first pick tip 115 will be positioned so that it can strum a stringed instrument. The user can then rotate the plectrum 100 between the user's fingers to a second position where a second pick tip is in a position to strum a stringed instrument. The rotation can be facilitated by the opening 225 in the center portion. The opening 225 can be located so that a central axis passing through the opening is the axis of rotation of the plectrum in rotating from the first position to the second position. By touching the fingers together through the opening 225 it is easy to rotate the plectrum about the axis of rotation. Also, by providing the protrusions in a manner that they each correspond to a pick tip, a user can feel when a pick tip is properly positioned in a location when the pick tip can strum a stringed instrument.

FIG. 4B also shows a version of a plectrum 100 of the invention which is designed and configured to be stowably attached to the stringed instrument. FIG. 4B shows a plurality of strings, such as guitar strings running along the neck of a guitar. In this version, the slot 210 in the plectrum 100 is sized and shaped to receive a string. By sizing the slots 210 properly, two of the slots 210 can receive an upper string and a third slot 210 can receive a lower string 310, or vice versa, so that the plectrum 100 can be held by compression between the upper string and the lower string. One or more intermediate strings may also pass over the plectrum 100 when stored between the upper string and the lower string to additionally compress the plectrum 100 against the neck of the guitar.

In the versions shown, the plectrum 100 has a general shape of an equilateral triangle. In other versions, the plectrum 100 can have a general shape other than an equilateral triangle. For example, the plectrum can be in the general form of an acute isosceles triangle with two equal rounded corners and a third corner less rounded. In yet other versions, the plectrum 100 can be circular, oval, square, rectangular, or any other geometric shape.

Figure 5:
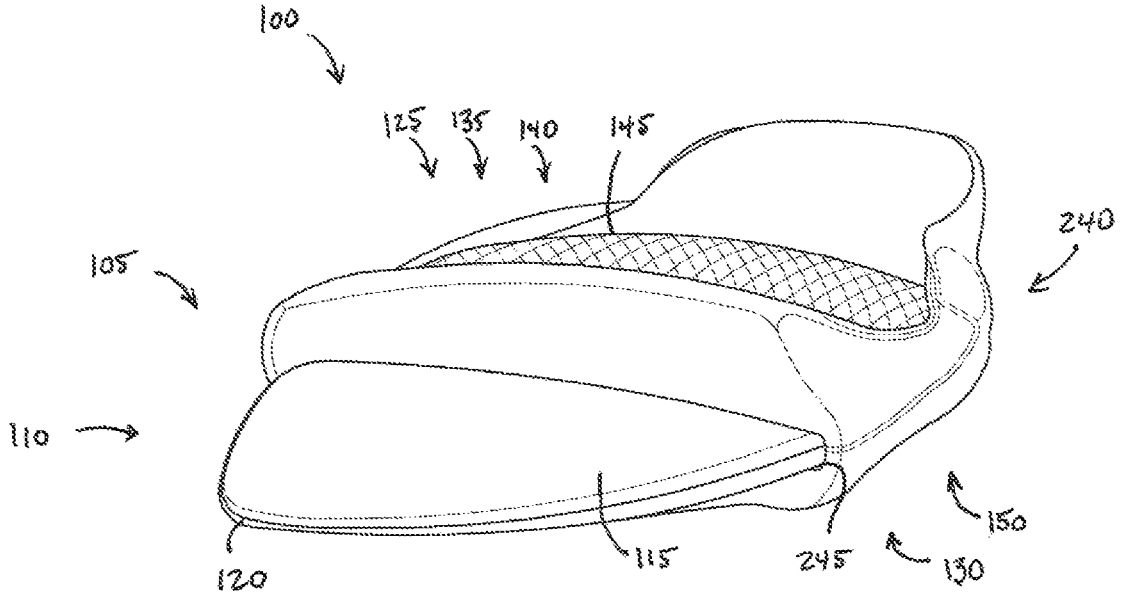
FIG. 5 is a schematic perspective view of another version of a plectrum according to the invention.

The plectrum 100 may be made from a single piece of material, such as being a single piece of molded plastic. Alternatively, the plectrum 100 may be made of a mdodular design. In yet another version, as shown in FIG. 5, the plectrum 100 may comprise an ergonomic jacket 240 into which a pick tip 115, such as a conventional pick may be inserted. The ergonomic jacket 240 includes a front ergonomic contour 135 and/or a rear ergonomic contour 150. The ergonomic jacket 240 has a slot 245 sized and shaped to releasably receive the pick tip.

The versions described and illustrated show exemplary sizes and shapes and relative dimensions for a plectrum 100. These dimensions, sizes, and shapes are not intended to limit the invention in any way. In general, the plectrum can have a length from edge 120 to edge 120 of from about 30 mm to about 60 mm, more preferably from about 40 mm to about 50 mm, and most preferably about 44 mm. The width of the plectrum 100 from tip edge 120 to an opposite side is preferably from about 25 mm to about 55 mm, more preferably from about 35 mm to about 45 mm, and most preferably about 40 mm. The thickness of the angled corner portions 110 can range from any of the dimensions discussed above. The thickness of the front radially extending protrusion 140 at its periphery end and/or the distance from the most outwardly extending portion of the lobe to the front face 125 can be from about 1.7 mm to about 4.7 mm, more preferably from about 2.7 mm to about 3.7 mm, and most preferably about 3.2 mm. The thickness of the rear radially extending protrusion 155 can be from about 1.2 mm to about 4.0 mm, more preferably from about 1.7 mm to about 3.0 mm, and most preferably about 2.2 mm. For different materials, the above dimensional ranges can change accordingly.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Therefore, any appended claims should not be limited to the description of the preferred versions contained herein and should include all such alterations, permutations, and equivalents as fall within the true spirit and scope of the present invention.

What is claimed is:

1. A plectrum for strumming a stringed instrument, the plectrum comprising:

a body having a front side, a rear side, a center portion, and a periphery, wherein the body has one or more pick tips having an edge adapted to strum a stringed instrument, and an ergonomic contour on the front side or the rear side of the body, the ergonomic contour comprising a protrusion rising outwardly from a plane containing the one or more pick tips and that extends radially from the center portion toward the periphery, the protrusion having one or more projections or recesses, wherein the ergonomic contour creates a surface that is contactable by the thumb or other finger of a user to aid in the gripping of the plectrum.

2. A plectrum according to claim 1 wherein the body has a first pick tip and a second pick tip and wherein the first pick tip is different than the second pick tip.

3. A plectrum according to claim 2 wherein first pick tip is different than the second pick tip by having a different size, shape, or material.

4. A plectrum according to claim 2 wherein the ergonomic contour comprises a second protrusion that extends radially from the center portion toward the periphery, wherein each protrusion is associated with a different pick tip.

5. A plectrum according to claim 1 wherein the protrusion comprises a concave recess.

6. A plectrum according to claim 1 wherein the ergonomic contour is on the front side and wherein the plectrum further comprises an ergonomic contour on the rear side, the ergonomic contour on the rear side having a protrusion that extends radially from the center portion toward the periphery.

7. A plectrum according to claim 6 wherein the ergonomic contour on the front side comprises a recess and wherein the ergonomic contour on the rear side comprises a flat portion.

8. A plectrum according to claim 6 wherein the ergonomic contour on the front side comprises three protrusions, wherein the ergonomic contour on the rear side comprises three protrusions, and wherein there are three different pick tips.

9. A plectrum according to claim 1 wherein the center portion comprises an opening so that a finger contacting the front side of the plectrum can touch a finger contacting the rear side of the plectrum.

10. A plectrum for strumming a stringed instrument, the plectrum comprising:

a body having a front side, a rear side, a center portion, and a periphery, wherein the body has a first pick tip having a first edge adapted to strum a stringed instrument and a second pick tip having a second edge adapted to strum a stringed instrument, and an ergonomic contour on the front side or the rear side of the body, the ergonomic contour comprising a first protrusion corresponding to the first pick tip and a second protrusion corresponding to the second pick tip, wherein the center portion is between the first protrusion and the first pick tip and wherein the center portion is between the second protrusion and the second pick tip, wherein the ergonomic contour creates a surface that is contactable by the thumb or other finger of a user to aid in the gripping of the plectrum.

11. A plectrum according to claim 10 wherein the first pick tip is different in size, shape, or material than the second pick tip.

12. A plectrum according to claim 10 wherein the body further comprises a third pick tip and wherein the ergonomic contour further comprises a third protrusion corresponding to the third pick tip.

13. A plectrum according to claim 12 wherein the pick tips are substantially equally spaced around the periphery of the body and wherein the protrusions are substantially equally spaced around the front side or rear side.

14. A plectrum according to claim 10 wherein the ergonomic contour is on the front side and further comprising an ergonomic contour on the rear side, wherein the ergonomic contour on the back side comprises a first protrusion corresponding to the first pick tip and a second protrusion corresponding to the second pick tip.

15. A plectrum according to claim 10 wherein the center portion comprises an opening so that a finger contacting the front side of the plectrum can touch a finger contacting the rear side of the plectrum.

16. A method of strumming a stringed instrument with a plectrum, the method comprising:

providing a plectrum having:

a body having a front side, a rear side, a center portion, and a periphery, wherein the body has a first pick tip having a first edge adapted to strum a stringed instrument and a second pick tip having a second edge adapted to strum a stringed instrument, and an ergonomic contour on the front side or the rear side of the body, the ergonomic contour comprising a first protrusion corresponding to the first pick tip and a second protrusion corresponding to the second pick tip, wherein each protrusion rises outwardly from a plane containing the first pick tip and the second pick tip and wherein each protrusion has one or more projections or recesses;

contacting the front side with a thumb or other finger;

contacting the rear side with a thumb or other finger; and rotating the plectrum between the fingers from a first position where the first pick tip is positioned to strum the stringed instrument to a second position where the second pick tip is positioned to strum the stringed instrument, wherein a different sound is produced in the first and second positions.

17. A method according to claim 16 wherein the center portion has an opening and wherein the method comprises rotating the plectrum about a central axis of the opening.

18. A plectrum according to claim 1 wherein the protrusion rises outwardly from the plane containing the one or more pick tips by at least about 1.7 mm.

19. A plectrum according to claim 4 wherein each protrusion is associated with a different pick tip located on the opposite side of the center portion from each protrusion.

20. A method according to claim 16 wherein the protrusion rises outwardly from the plane containing the first pick tip and the second pick tip by at least about 1.7 mm.

* * * * *